United States Patent [19]

Yokokawa

[11] Patent Number: 4,779,499

[45] Date of Patent: Oct. 25, 1988

[54] APPARATUS FOR STACKING SLICED PRODUCTS FROM SLICING MACHINE

[75] Inventor: Toshiyuki Yokokawa, Tokyo, Japan

[73] Assignee: Omori Machinery Co., Ltd., Japan

[21] Appl. No.: 97,450

[22] Filed: Sep. 16, 1987

[30] Foreign Application Priority Data

Sep. 17, 1986 [JP] Japan ..... 61-217251

[51] Int. Cl.[4] ..... B26D 7/32

[52] U.S. Cl. ..... 83/92; 83/157; 414/49; 414/50

[58] Field of Search ..... 83/90–92, 83/77, 355; 414/48–50; 271/218

[56] References Cited

U.S. PATENT DOCUMENTS 3,821,913 7/1974 Bajcar et al. ..... 83/92
4,405,186 9/1983 Sandberg et al. ..... 414/50
4,428,263 1/1984 Lindee et al. ..... 83/355

FOREIGN PATENT DOCUMENTS 1205987 12/1965 Fed. Rep. of Germany ..... 414/49
57-8098 1/1982 Japan .

*Primary Examiner*—E. R. Kazenske
*Assistant Examiner*—Hien H. Phan
*Attorney, Agent, or Firm*—Emrich & Dithmar

[57] ABSTRACT

An apparatus is provided for stacking sliced products from a slicing machine of the type in which a loaf is fed into a cutting blade to be cyclically sliced. The apparatus comprises a first stack receiver and a second stack receiver each comprising a pair of receiving plates and operable between a closed position where the receiving plates are adjacent each other for accumulating the slices and an open position where the receiving plates are spaced from each other for discharging the slices. The stack receivers are moved in the vertical direction such that one of them is in the raised position when the other of them is in the lowered position. The stack receivers are closed at the raised position and opened at the lowered position. The slices can be discharged from the stack receiver with maintaining an aligned condition.

19 Claims, 3 Drawing Sheets

APPARATUS FOR STACKING SLICED PRODUCTS FROM SLICING MACHINE

BACKGROUND OF THE INVENTION

1. Field of of the Invention

The present invention relates to an apparatus for stacking sliced products from a slicing machine, and more particularly to an apparatus which receives accurately slices of ham, bacon and so on from a slicing machine, stacks a predetermined number of slices and transfers them to conveyor means of a packaging device.

2. Description of the Prior Art

In the manufacture of sliced ham and the like it is well known in the art to feed a loaf of material about 1 to 2 meters long into a rotary cutting blade which forms slices of a predetermined thickness cyclically from the end of the loaf. In order to package a stack of several slices, it is necessary that an apparatus for stacking the slices be provided before the conveyor. One example of such apparatus is disclosed in Japanese Patent Laid-Open No. 57-8098. This apparatus comprises a pair of gourd-shaped receiving plates which are rotatable and movable in a vertical direction such that each of the plates rotate 180 degrees about the center thereof when it reaches the lower position. The slices cut by the blade are succesively collected across the paired receiving plates, and the receiving plates are gradually lowered as the slices are stacked. After a predetermined number of the slices are stacked, the paired receiving plates are rotated such that the slices stacked thereon are released to be dropped onto the conveyor, the slices being conveyed in the stacked condition to a packaging machine. The receiving plates, after releasing the stack onto the conveyor, move up to the initial position at high speed to accumulate a next stack.

Since, however, the slicing machine continues slicing the loaf while the receiving plates rotate to drop the stack and move up, the plates must be elevated to the initial position immediately with very high speed in order to receive the slices without fail and in order to prevent the slices from free falling a long distance for the purpose of aligning the stack. Such a high speed movement of the receiving plates is not advantageous because it entails excessive load on the mechanism and tends to cause vibrations with reducing a lifetime of the machine. In addition, the vertical movements of the receiving plates are effected by a system incorporating two pneumatic cylinders, resulting in a complicated structure of the machine and a troublesome work for accurately controlling the movements. Furthermore, the rotational movements of the receiving plates for releasing the stack tend to displace the slices due to centrifugal force so that the stack dropped on the conveyor is misaligned or misplaced.

It is therefore an object of the present invention to provide an apparatus for stacking slices from a slicing machine in which a stack receiver may be elevated to a receiving position at moderate speed for eliminating vibration.

It is another object of the present invention to provide an apparatus for stacking sliced products from a slicing machine which can transfer a stack on a receiver to a conveyor of a subsequent device accurately and without causing substantial misalignment.

A further object of the invention is to provide an apparatus of the kind set forth above which is relatively simple in structure and reliable in operation.

SUMMARY OF THE INVENTION

According to the invention, an apparatus for stacking sliced porducts from a slicing machine in which a loaf is fed into a cutting blade to be cyclically sliced includes a first stack receiver and a second stack receiver disposed below the cutting blade. Each stack receiver comprises a pair of receiving members and is operable between a closed position where the receiving members are adjacent each other for accumulating the slices and an open position where the receiving plates are spaced from each other for releasing the slices. Means for moving the first and second stack receivers is provided whereby one of these stack receivers is in the raised position adjacent the cutting blade when the other thereof is in the lowered position away from the cutting blade. The apparatus also includes means for operating the stack receivers between the closed position and the open position Whereby the stack receiver is closed at the raised position and is opened at the lowered position.

When the first stack receiver is open in the uppermost position, the second stack receiver is closed in the lowermost position. From these positions, the first stack receiver is lowered while accumulating the slices, and the second stack receiver is raised. During these movements, since the second stack receiver is opened, it can move up smoothly to the uppermost position while permitting the first stack receiver to pass between the receiving members of the second stack receiver. When the first stack receiver reaches the lowermost position, it opens to discharge the stack. At the same time the second stack receiver reaches the uppermost position and is closed so that it is ready to receive succeeding slices cut by the blade. By repeating these operations, the apparatus can stack the slices in alignment and release the stacks of slices downward without causing misalignment.

Other objects, features and advantages of the invention will be apparent from the following detailed description thereof when taken in conjunction with the accompanying drawings.

DETAILED DESCRIPTION OF THE INVENTION

Figure 1:
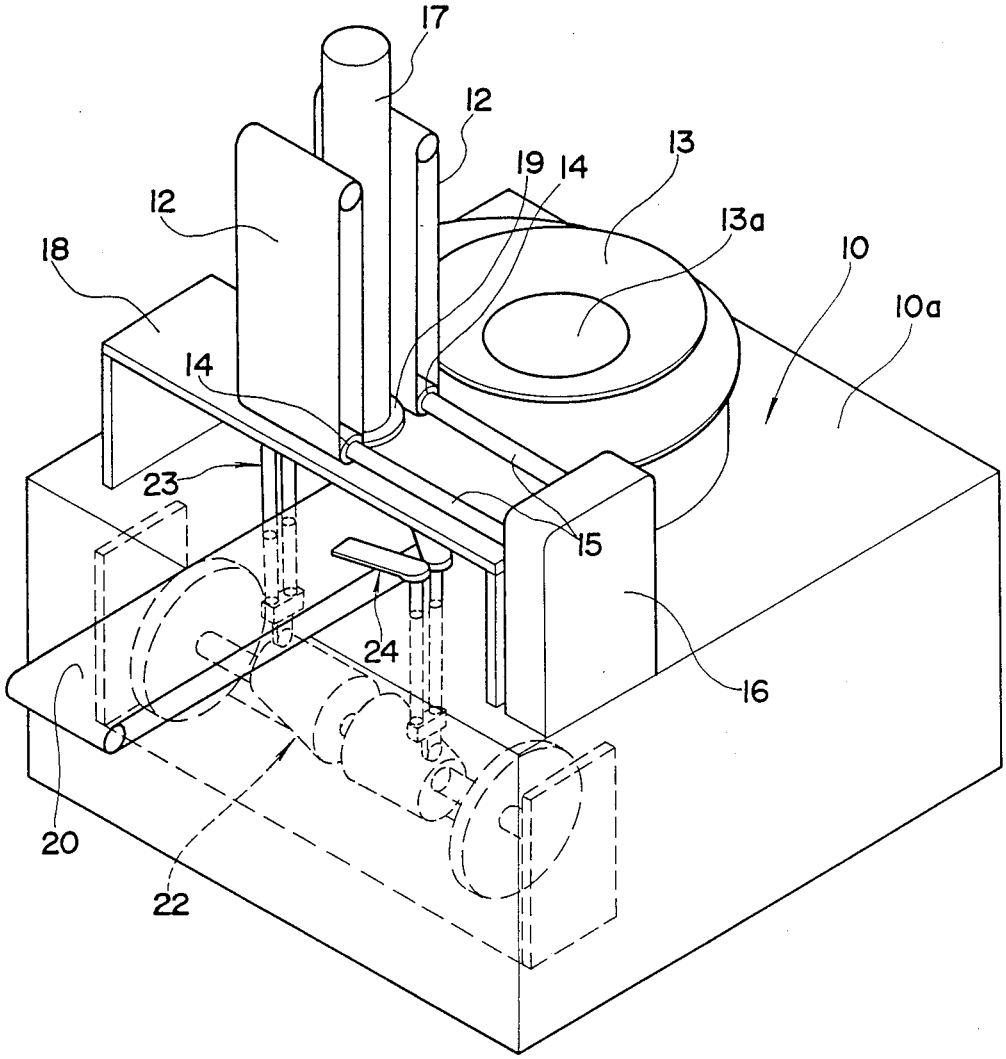
FIG. 1 is a perspective view showing schematically a stacking apparatus of the present invention and a slicing machine combined therewith.

Referring first to FIG. 1, a general description of a slice machine to which the present invention is applied is given below. A box-like body 10 has a support 18 in the form of a gate and secured to a front portion of the upper surface 10*a* of the body. Disposed on the support 18 are a pair of upright rotary belts 12 which are spaced from each other to feed a loaf 17 therebetween and which include at the lower ends respective drive pulleys connected to a drive device 16 through shafts 15. The drive device 16 is attached on the upper surface 10*a* adjacent the support 18 and connected to a known power transmission mechanism (not shown) within the body 10 for rotating the shafts 15 and therefore the pulleys 14 intermittently. During each rotational movement of the pulleys 14, the rotary belts 12 advance the loaf 17 a distance which is determined to correspond to a desired thickness of a slice to be cut. The upper surface of the support 18 is formed centrally thereof with an opening through which the loaf 17 is permitted to advance downwardly. A ring-shaped guide member 19 is fitted in the opening and has an inner diameter substantially equal to the diameter of the loaf 17 to prevent a dispacement of the end portion of the loaf 17 in the horizontal direction.

Rotatably mounted on the upper surface 10*a* of the body 10 is a cutting blade 13 which is positioned at a level slightly below the lower end of guide member 19 as seen from FIG. 2. A rotational axis 13*a* of the blade 13 is so eccentric that during rotation the blade 13 cyclically slices the loaf 17. The advance of the loaf 17 is effected during the blade 13 is in the inoperated position away from the loaf 17. A conveyor 20 is disposed below the guide member 19 to feed the slices as cut to a subsequent process such as packaging.

Figure 3:
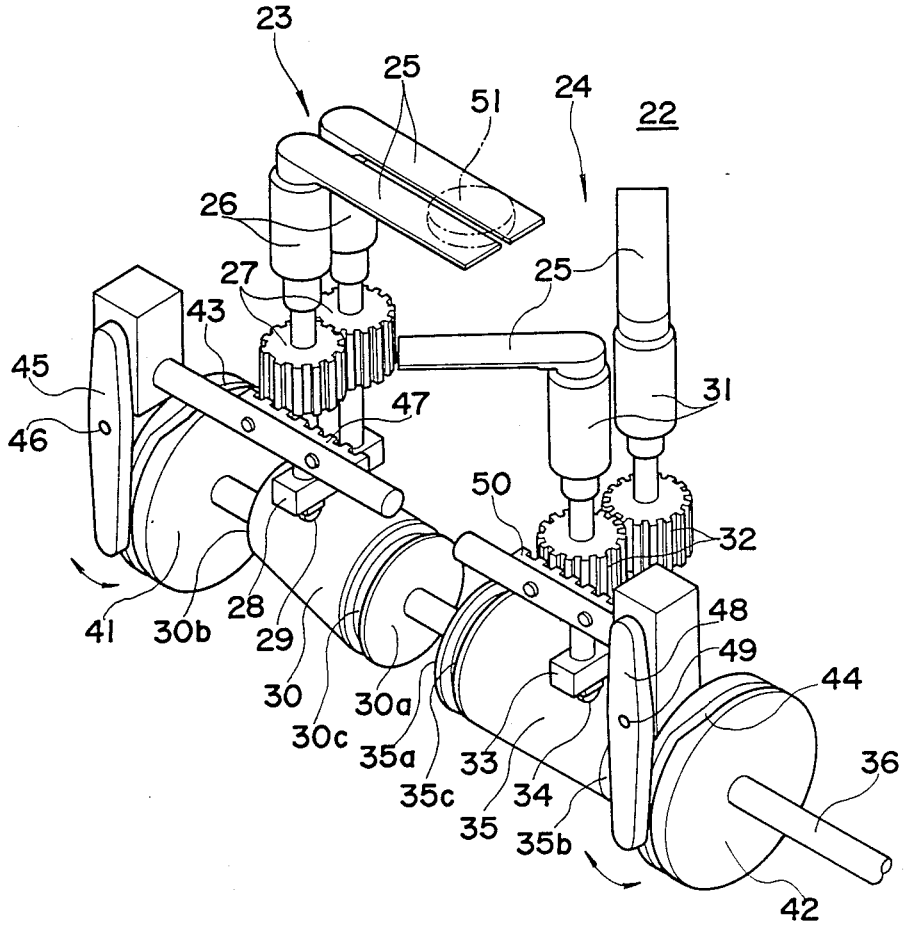
FIG. 3 is an enlarged perspective view showing various parts of the apparatus.

An apparatus of the invention, generally indicated by numeral 22, is provided to stack a predetermined number of slices as cut by the blade 13 and to transfer the stacked slices to the conveyor 20. The apparatus 22 includes a first stack receiver 23 and a second stack receiver 24 both disposed between the blade 13 and the conveyor 20. As best shown in FIG. 3, each of the stack receivers 23 and 24 comprises a pair of horizontally extending thin plates 25 having a rectangular shape in plane and arranged in side by side relationship. The plates 25 of the first stack receiver 23 are fixed at their ends away from the opening of the support 18 to the upper ends of respective vertical shafts 26, so that a rotational movement of the shafts 26 moves the first receiver 23 to an open position where the ends of the plates 25 away from the shafts are spaced from each other or to a closed position where those ends are adjacent each other, depending on a direction of rotation. Vertically elongated pinions 27 are fitted on the respective shafts 26 at the lower portion thereof and are engaged with each other. The lower ends of these shafts are rotatably secured to a support piece 28 which supports a roller 29 in a rotatable manner. The roller 29 rests on a first cylindrical cam 30 having an axis extending in the horizontal direction and rolls along the peripheral surface of the cam 30 as it rotates, whereby the shaft 26 and the first stack receiver 23 fixed thereto are moved up and down.

Similarly, the plates 25 of the second stack receiver 24 are fixed to shafts 31 having pinions 32 engaging with each other, the lower ends of shafts 31 being rotatably secured to a support piece 33 supporting a roller 34. A second cylindrical cam 35 is provided on which the roller 34 rests to roll along the peripheral surface of the cam as it rotates, thereby moving the second stack receiver 24 up and down.

Figure 2:
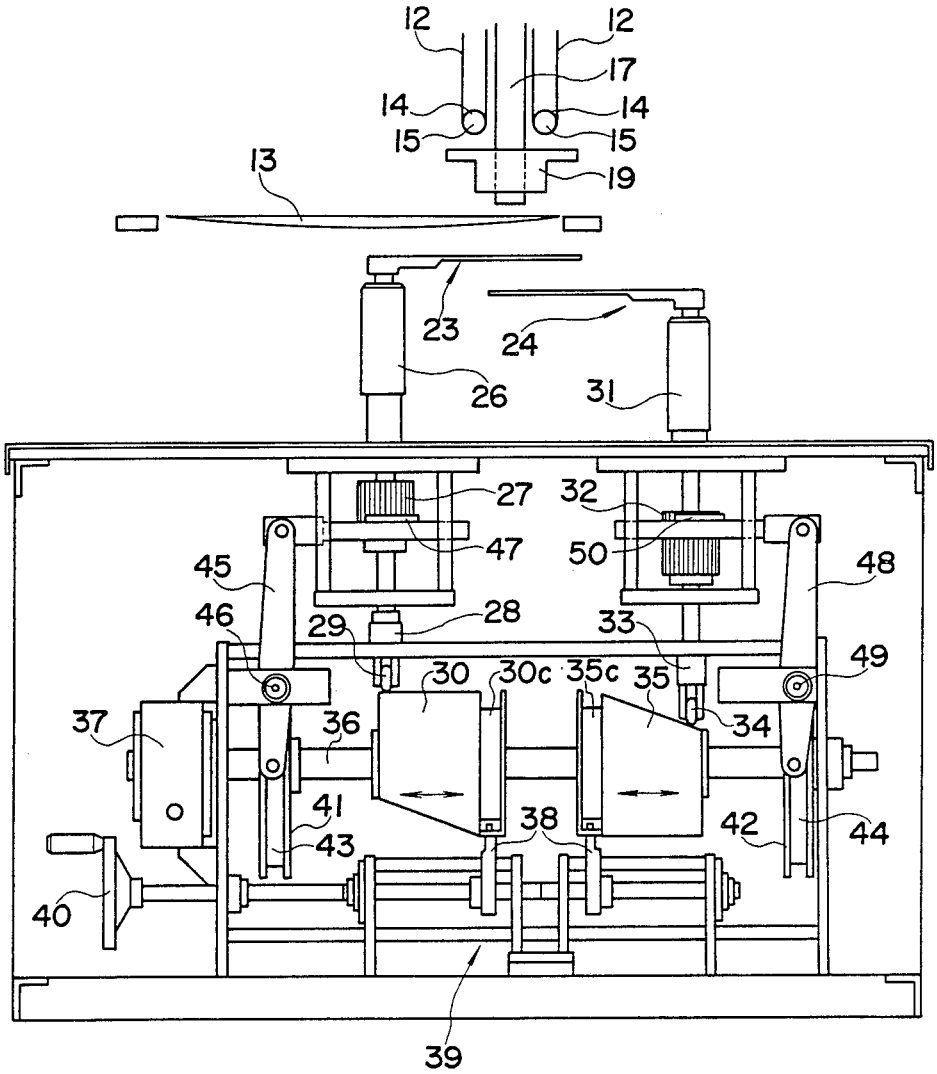
FIG. 2 is a sectional view of the apparatus in FIG. 1.

Each of the first and second cams 30 and 35 is in the shape of a truncated cone having a trapezoid longitudinal section with a horizontally extending line as shown in FIG. 2. These cams 30, 35 are slidably fitted on a common shaft 36 extending in the horizontal direction for co-rotation therewith, in such a manner that the larger-diametered end surfaces 30*a* and 35*a* face each other and that there is a 180 degree phase difference between the cams 30 and 35. The shaft 36 is keyed to the cams 30, 35 concentrically at the end surfaces 30*a*, 35*a* but eccentrically at the smaller-diametered end surfaces 30*b*, 35*b*. A drive source 37 is attached to one end of the shaft 36 for rotating the same. Formed on the peripheral surfaces of the cams 30, 35 adjacent the end surfaces 30*a*, 35*a* are annular grooves 30*c*, 35*c*, respectively, with which are engaged projections 38 of a cam positioner 39. The positioner 39 is adapted to adjust a distance between the two projections 38 by rotating a handle 40, so that the cams 30, 35 can be secured at a desired position along the shaft 36.

Attached on the shaft 36 adjacent opposite ends thereof are disks 41, 42 having annular grooved cams 43, 44 on their peripheral surfaces, respectively. Each grooved cam comprises straight portions extending parallel to the end faces of the disk and inclined portions connecting the straight portions. A cam follower 45 pivotted at 46 is engaged at its lower end with the grooved cam 43 and is swingably connected at its upper end to the end of a rack 47 which engages with one of the pinions 27. Similarly, a cam follower 48 pivotted at 49 is engaged with the grooved cam 44 and swingably linked to a rack 50 engaging with one of the pinions 32. Thus, a swing motion of the cam follower 45 caused by a rotation of the cam groove 43 moves the rack 47 in the longitudinal direction. Such a movement of the rack 47 rotates the shafts 16 through the pinions 27 to open or close the stack receiver 23. The pinion 27 has a width sufficient to enable the rack 47 to engage therewith through an entire travel of the shaft 26 in the vertical direction. That is, the rack 47 engages with the lower portion of the pinion 27 when the shaft 26 and, therefore, the first stack receiver 23 are in the raised position as shown in FIG. 2. As the shaft 26 descends, the pinion 27 slides relative to the rack 47 while maintaining the engagement therebetween. When the shaft 26 reaches its lowered position, the rack 47 engages with the upper portion of the pinion 27. The same arrangements are also applied to the second stack receiver 24 and therefore a further description will be omitted.

It is now assumed that the apparatus 22 is in the initial position as shown in FIG. 3 in which the first stack receiver 23 is in the raised position with the plates 25 being closed and the second stack receiver 24 is in the lowered position with the plates 25 being open. From this initial position, the first stack receiver 23 gradually descends as the cylindrical cam 30 rotates, while accumulating slices 51 cut by the blade 23. Simultaneously, the second stack receiver 24 is gradually raised, at the same speed as the first stack receiver 24 descends, by the rotation of the cylindrical cam 35. During these vertical movements of the stack receivers the cam followers 45 and 48 are engaged with the straight portions of the grooved cams 43 and 44, respectively. Therefore, the first stack receiver 23 is maintained closed and the second stack receiver 24 is maintained open, permitting the former to pass between the plates 25 of the latter.

When the first stack receiver 23 reaches the lowermost position, the lower end of cam follower 45 moves into the inclined portion of the grooved cam 43 to swing the follower 45 about the pivot 46 in a counterclockwise direction in FIG. 2. The rack 47 is thus moved toward the left-hand side with rotating the pair of pinions 27, so that the plates 25 of the first stack receiver 23 is opened to release the stack 51 onto the conveyor 20 of, for example, a packaging machine. Since a weight of the stack 51 is distributed substantially evenly between the two plates 25, and since the plates 25 are opened symmetrically, the stack 51 is not affected by the movement of either one of the plates 25 during the opening of the latter. Therefore, at the moment the plates 25 are fully opened, the stack 51 falls onto the conveyor with the slices being aligned.

Simultaneously, the second stack receiver 24 reaches the uppermost position and the cam follower 48 swings about the pivot 49 in the counterclockwise direction to move the rack 50 toward the left-hand side. The second stack receiver 24 is therefore closed for accumulating the slices as cut by the blade 13, the first slice being the one just following the last slice stacked on the first receiver 23. The second receiver 24, as in the first receiver 23, gradually descends with maintaining the closed position until a predetermined number of slices are stacked thereon. The stack is then released onto the conveyor 20 at the lowermost position of the second receiver 24. At this time, the first receiver 23 has reached its uppermost position as shown in FIG. 3. These operations are repeated to supply onto the conveyor 20 the stacks each having a predetermined number of slices at time intervals.

The number of slices in each stack can be varied by changing the rotational speed of either the blade 13 or the shaft 36. For example, if it is desired to reduce the number of slices, either the blade 13 is turned more slowly or the shaft 36 is rotated more rapidly. As the number of slices in each stack decreases, the vertical stroke of the receivers 23, 24 should become shorter. In the above apparatus, the vertical stroke of the receivers 23, 24 is adjustable by the portion of the cylindrical cams 30, 35 on which the rolls 29, 34 rest, and by moving the cylindrical cams along the shaft 36 by the positioner 39 such that a distance between the end surfaces 30*a* and 35*a* is changed.

In case that the number of slices in each stack need not be varied, it will be sufficient to provide simple disk cams eccentrically mounted on the shaft 36, instead of providing the cylindrical cams 30, 35.

The above cam mechanism for moving the stack receivers is preferable particularly from the viewpoint of reliability, but various other structures may be used for controlling the movement of the stack receivers. Also, the stack receiver may be partly open during descending movement as long as it can receive the slices and may be partly closed during elevation so far as it permits the elevational movement of the other stack receiver.

As it could be understood from the foregoing description, the stack receivers may be moved at moderate speed throughout the cycle without a necessity of rapid elevation. This reduces vibration of the apparatus and requires less mechanical strength, facilitating a design and a manufacture. Further, the opening operation of the stack receiver comprising the two plates is carried out by moving the ends of the plates away from each other, and therefore the stack can be maintained as aligned during transfer to the conveyor.

Although the present invention has been described with reference to the preferred embodiments thereof, many modifications and alterations may be made within the spirit of the invention.

What is claimed is:

1. An apparatus for stacking sliced products from a slicing machine in which a loaf is fed into a cutting blade to be cyclically sliced, the apparatus comprising:

a first stack receiver and a second stack reciver disposed below the cutting blade and each comprising a pair of receiving members, each saids stack receiver being operable between a closed position where said receiving plates are adjacent each other for acumulating the slices and an open position where said receiving members are spaced from each other for releasing the slices;

means for moving said first and second stack receivers in the vertical direction whereby one of said first and second stack receivers is in the raised position adjacent the cutting blade when the other of said first and second stack receivers is in the lowered position away from the cutting blade, said stack receiver moving means including a first cam for moving said first stack receiver and a second cam for moving said second stack receiver, said first and second cams being arranged with a 180 degree phase difference therebetween; and means for operating said first and second stack receivers between said closed position and said open position whereby each said stack receiver is closed at the raised position and opened at the lowered position.

2. An apparatus for stacking sliced products from a slicing machine in which a loaf is fed into a cutting blade to be cyclically sliced, the apparatus comprising:

a first stack receiver and a second stack receiver disposed below the cutting blade and each comprising a pair of receiving plates, each said stack receiver being operable between a closed position where said receiving plates are adjacent each other for accumulating the slices and an open position where said receiving plates are spaced from each other for releasing the slices;

means for moving said first and second stack receivers in the vertical direction whereby one of said first and second stack receivers is in the raised position adjacent the cutting blade when the other of said first and second stack receivers is in the lowered position away from the cutting blade, said stack receiver moving means including a first cam for moving said first stack receiver and a second cam for moving said second stack receiver, said first and second cams being arranged with a 180 degree phase difference therebetween; and means for operating said first and second stack receivers between said closed position and said open position whereby each said stack receiver is closed at the raised position and opened at the lowered position.

3. An apparatus as claimed in claim 2, wherein said stack receiver moving means further includes a shaft on which said first and second cams are eccentrically fitted.

4. An apparatus as claimed in claim 3, wherein said stack receiver moving means further comprises cam followers separately connected to each said stack receiver.

5. An apparatus as claimed in claim 4, wherein said cam follower comprises a pair of rod members each fixedly secured at one end thereof to said receiving plate, a support member rotatably secured to the other ends of said rod members, and a roller on said support member for rolling along the peripheral surface of said cam.

6. An apparatus as claimed in claim 5, wherein said receiving plate is swingable in a horizontal plane about said rod member.

7. An apparatus as claimed in claim 6, wherein said stack receiver operating means comprises means for rotating said rod members.

8. An apparatus as claimed in claim 7, wherein said rod member rotating means includes a pinion fitted on each said rod member, a rack engaging with said pinion, and means for moving said rack to thereby rotate said pinion.

9. An apparatus as claimed in claim 8, wherein said pinion has a width sufficient to permit the engagement with said rack throughout the travel of said rod member.

10. An apparatus as claimed in claim 8, wherein said rack moving means comprises a pair of annular grooved cams each having straight portions and inclined portions, and a pair of swing arms each secured at one end thereof to said rack and engaging at the other end thereof with said grooved cam.

11. An apparatus as claimed in claim 10, wherein said grooved cams are fitted on said shaft for co-rotation with said cams.

12. An apparatus as claimed in claim 3, wherein each said cam has a shape of a truncated cone and is slidably keyed to said shaft for enabling adjustment of a distance of the vertical movement of said stack receiver.

13. An apparatus as claimed in claim 12, wherein said cam has an annular groove formed thereon, and wherein said stack receiver moving means further includes a positioner having a pair of projections each engaging with said annular groove, said positioner being adapted to adjust a distance between said projections.

14. An apparatus as claimed in claim 2, wherein said receiving plate has in plan view a rectangular shape.

15. An apparatus as claimed in claim 2, wherein said first and second stack receivers are oppositely arranged.

16. An apparatus for stacking sliced products from a slicing machine in which a loaf is fed into a cutting blade to by cyclically sliced, the apparatus comprising:

a first stack receiver and a second stack receiver disposed below the cutting blade and each comprising first and second receiving members, each said stack receiver being operable between a closed position where said receiving members are adjacent each other for accumulating the slices and an open position where said receiving members are spaced from each other for releasing the slices;

means for moving said first and second stack receivers in the vertical direction whereby one of said first and second stack receivers is in the raised position adjacent the cutting blade when the other of said first and second stack recivers is in the lowered position away from the cutting blade, said stack receiver moving means including cam means having a first cam portion for moving said first stack receiver and a second cam portion for moving said second stack receiver, said first and second cam portions being arranged with a 180 degree phase difference therebetween and cam follower means including a cam follower separately connected to each said stack receiver; and means for operating said first and second stack receivers between said closed position and said open position whereby each said stack receiver is closed at the raised position and opened at the lowered position.

17. An apparatus as claimed in claim 16, wherein said first and second cam portions each has a shape of a truncated cone.

18. An apparatus as claimed in claim 17, wherein each said cam follower comprises first and second rod members each fixedly secured at one end thereof to the first and second receiving members, respectively, a support member rotatably secured to the other end of said rod member, and a roller on said support member for rolling along the peripheral surface of said cam portion.

19. An apparatus as claimed in claim 18, wherein said stack receiver operating means comprises means for rotating said rod members.

* * * * *